United States Patent [19]

Rones

[11] 4,047,261

[45] Sept. 13, 1977

[54] MOP WRINGER

[76] Inventor: James M. Rones, P.O. Box 47200, Atlanta, Ga. 30340

[21] Appl. No.: 717,420

[22] Filed: Aug. 24, 1976

[51] Int. Cl.[2] ..... A47L 13/14; A47L 13/58

[52] U.S. Cl. ..... 15/261

[58] Field of Search ..... 15/260–263; 100/126, 243, 293; 68/241

[56] References Cited

U.S. PATENT DOCUMENTS 1,268,921 6/1918 Brace ..... 15/261

3,699,606 10/1972 Ribas ..... 15/261

*Primary Examiner*—Leonard D. Christian

*Attorney, Agent, or Firm*—Sughrue, Rothwell, Mion, Zinn and Macpeak

[57] ABSTRACT

A downward pressure mop wringer is disclosed. It comprises a hopper, a pivoted pressure plate mounted in the hopper, a crank-arm linkage to actuate the pressure plate, a handle to actuate the crank-arm linkage, and a spring to return the pressure plate to normal position after use.

6 Claims, 5 Drawing Figures

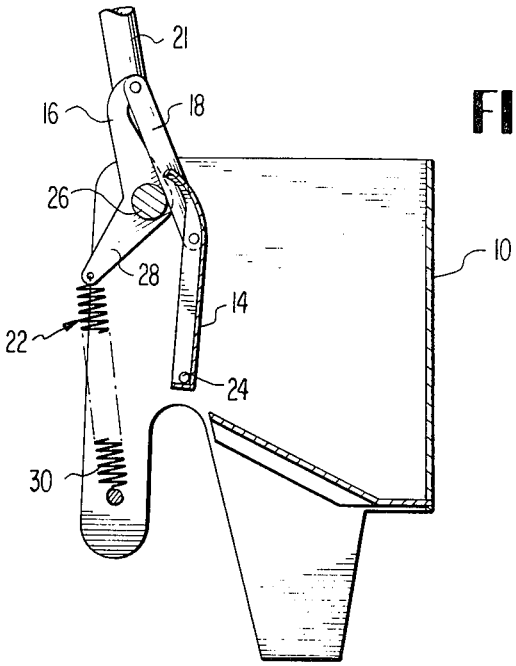
FIG. 3
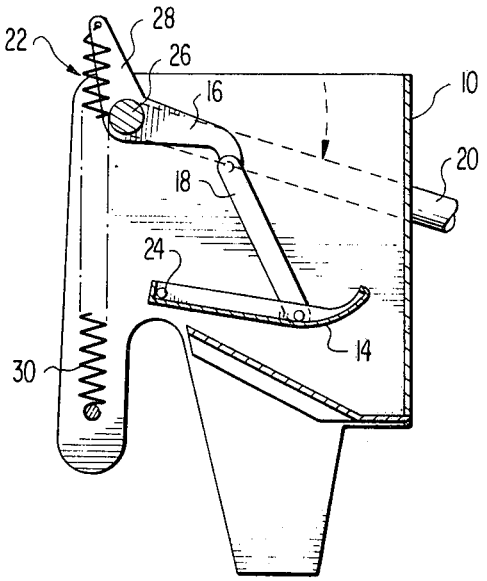
FIG. 5
FIG. 4
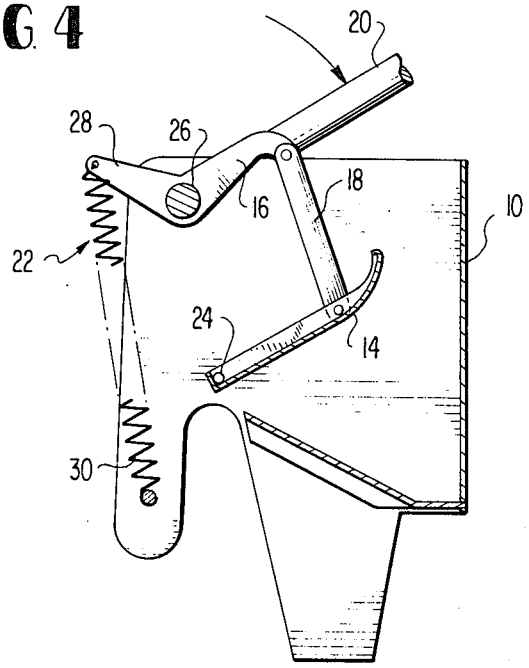

MOP WRINGER

FIELD OF THE INVENTION

This invention relates generally to mop wringers. Specifically, it relates to mop wringers of the downward pressure variety.

DESCRIPTION OF THE PRIOR ART

The prior art known to me comprises basically two types of mop wringers: vertical squeeze wringers and downward pressure wringers.

In the vertical squeeze wringer, one wall of the hopper pivots inwardly about its bottom edge, catching the mop-head between a fixed wall and the pivoting wall. These mop wringers have two major disadvantages. First, since the mop strands fall unevenly downwardly into the hopper, the pressure exerted on the strands by the pressure plate is uneven, and the mop-head therefore is normally not wrung dry. Second, since water flows downward, the water being squeezed out of a mop-head in a vertical squeeze wringer tends to flow down through the mop-head itself, resulting in an inefficient wringing.

In heretofore known downward pressure wringers, two pressure plates are hingedly mounted on the top of opposing walls of the hopper. The mop-head is inserted between the pressure plates, and they are then pivoted down synchronously by a rack-and-pinion mechanism to catch the mop-head between the bottom of the hopper and the two pressue plates. This variety of mop wringer does not suffer from the second of the two disadvantages mentioned above with respect to vertical squeeze swingers, but it is even more subject to the first disadvantage than are vertical squeeze wringers unless the mop strands are evenly disposed on the bottom of the hopper, since the two pressure plates move in synchronism.

SUMMARY OF THE INVENTION

The subject downward pressure mop wringer comprises a hopper, a single pressure plate mounted in the hopper for limited rotation about a horizontal axis located toward the botttom of the hopper, a crank-arm linkage to activate the pressure plate, a handle to activate the crank-arm linkage, and a spring to return the pressure plate to its normal position after use. The pressure plate exerts downward pressure on all mop strands evenly, causing the mophead to be wrung drier than is the case with the prior-art downward pressure mop wringers, and the crank-arm linkage uses half the parts of the prior-art rack-and-pinion mechanism, substantially lowering the cost of the wringer.

BRIEF DESCRIPTION OF THE DRAWINGS

FIGS. 3–5 are schematic side sectional views of a mop wringer according to the present invention showing the actuation of the pressure plate mechanism.

DETAILED DESCRIPTION OF A PREFERRED EMBODIMENT

Figure 1:
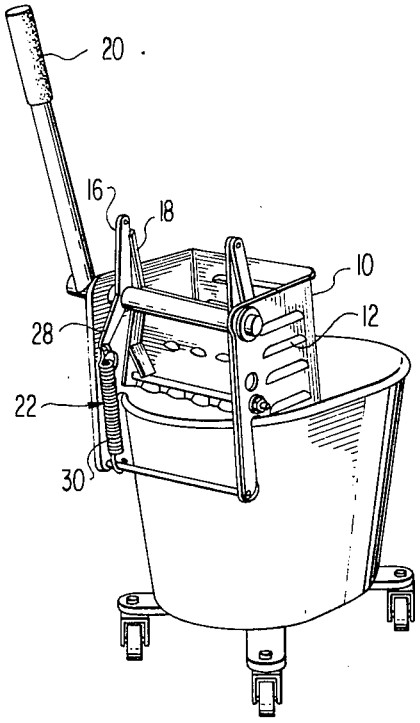
FIG. 1 is a perspective view of a mop wringer according to the present invention emplaced in a roller-mounted bucket.
Figure 2:
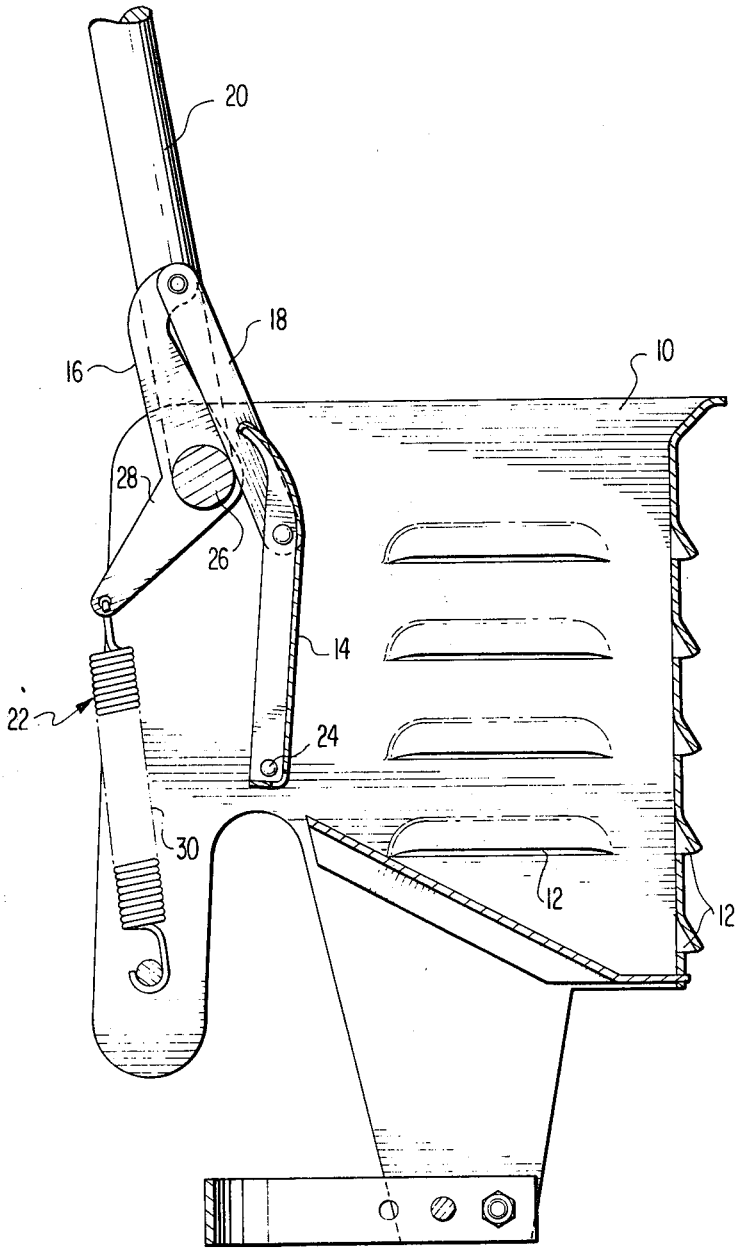
FIG. 2 is a side sectional view of a mop wringer according to the present invention.

A downward pressure mop wringer according to the present invention comprises an open-topped hopper 10 sized to receive a mop-head to be wrung and having apertures 12 therein to permit exit of wrung-out water, a pressure plate 14, a crank-arm 16, a link arm 18 pivotably connecting the crank-arm 16 to the pressure plate 14, means 20 for causing rotation of the crank-arm 16 in order to wring a mop-head, and means 22 for causing rotation of the crank-arm 16 in order to return the crank-arm 16 to its normal position upon release of the means 20. The pressure plate 14 is mounted in the hopper 10 for limited rotation about a horizontal axis 24 located towards the bottom of the hopper 10, and it is approximately vertically disposed in the normal state of the mop wringer (that is, when it is not being used for wringing out a mop-head). Similarly, the crank-arm 16 is mounted for limited rotation about a horizontal axis 26 located towards the top of the hopper 10. The rotation of the crank-arm 16 due to the means 20 causes the pressure plate 14 to rotate from its normally approximately vertical position to a position wherein it will exert downward pressure on a mop-head located in the hopper 10, and the rotation of the crank-arm 16 due to the means 22 causes the pressure plate 14 to rotate back to its normal position upon release of the means 20.

In the presently preferred embodiment illustrated in the drawings, the crank arm 16 is mounted on a horizontally disposed shaft 36 journaled in the sides of the hopper 10, and the means 20 comprise a handle mounted on the shaft outside the hopper 10. However, the handle could be mounted on the shaft inside the hopper 10, or even replaced with a wheel mounted on the end of the shaft. Similarly, in the present preferred embodiment illustrated in the drawings, the means 22 comprise a crank-arm 28 mounted on the same shaft as the crank-arm 16 and a spring 30 connecting the crank-arm 28 to the hopper 10, but the crank-arm 28 and the spring 30 could be replaced by a butterfly spring mounted directly on the shaft. Moreover, the crank-arms 16 and 28 are preferably made integral with one another as illustrated, but they need not be, and the crank-arm 16 is preferably mounted on the shaft inside the hopper 10, but it need not be.

In the present invention, the length and location of the pressure plate 14 are such that it can pivot from its normal approximately vertical position illustrated in FIG. 3, through the position illustrated in FIG. 4, to the horizontal or downwardly angled position illustrated in FIG. 5. As the pressure plate 14 moves in the fashion illustrated in FIGS. 4 and 5, a mop-head previously placed in the hopper 10 is caught between the bottom of the pressure plate 14 and the inside bottom of the hopper 10, and it is evenly and powerfully wrung out, resulting in a relatively dry mop-head with a minimum of work.

Caveat

While the present invention has been illustrated by a detailed description of the presently preferred embodiment thereof, it will be obvious to those skilled in the art that various changes in form and detail can be made therein without departing from the true scope of the invention. Accordingly, the invention must be measured by the claims appended hereto and not by the foregoing preferred embodiment.

What is claimed is:

1. A downward pressure mop wringer comprising:

a. an open-topped hopper sized to receive a mop-head to be wrung and having apertures therein to permit exit of wrung out water;

b. a pressure plate mounted in said hopper for limited rotation about a first horizontal axis located towards the bottom of, and within, said hopper, said pressure plate being approximately vertically disposed in the normal state of the mop wringer;

c. a first crank-arm mounted for limited rotation about a second horizontal axis located towards the top of said hopper;

d. a link arm pivotably connecting said crank-arm to said pressure plate;

e. first means for causing rotation of said crank-arm so as to cause said pressure plate to rotate from its normal approximately vertical position to a position wherein it will exert downward pressure on a mop-head located in said hopper; and f. second means for causing rotation of said crank-arm so as to cause said pressure plate to rotate back to its normal position upon release of said first means.

2. A downward pressure mop wringer as recited in claim 1, further comprising:

a shaft rotatably mounted on said hopper along said second horizontal axis; and wherein:

said first crank arm is mounted on said shaft, and said first means comprises a handle mounted on said shaft.

3. A downward pressure mop wringer as recited in claim 1, further comprising:

a shaft rotatably mounted on said hopper along said second horizontal axis; and wherein:

a. said first crank-arm is mounted on said shaft, and b. said second means comprises:

i. a second crank-arm mounted on said shaft, and ii. a spring connecting said second crank-arm to said hopper.

4. A downward pressure mop wringer as recited in claim 3, wherein said first and second crank-arms are integral with one another.

5. A downward pressure mop wringer as recited in claim 1, wherein the length and location of said pressure plate are such that it can pivot to a horizontal position within said hopper.

6. A downward pressure mop wringer as recited in claim 5 wherein the distance between said first and second horizontal axes is less than the length of said pressure plate.

* * * * *